US007841344B2

(12) United States Patent
Schlosser

(10) Patent No.: US 7,841,344 B2
(45) Date of Patent: Nov. 30, 2010

(54) JACKET AND METHOD FOR SURVIVING AN AVALANCHE

(76) Inventor: Sara E. Schlosser, N4883 460$^{th}$ St., Menomonie, WI (US) 54751

( * ) Notice: Subject to any disclaimer, the term of this patent is extended or adjusted under 35 U.S.C. 154(b) by 1162 days.

(21) Appl. No.: 10/992,942

(22) Filed: Nov. 19, 2004

(65) Prior Publication Data

US 2006/0107952 A1 May 25, 2006

(51) Int. Cl.
*A62B 7/00* (2006.01)
*A62B 9/00* (2006.01)

(52) U.S. Cl. ..... 128/205.22; 441/87; 441/88; 441/94; 441/102; 441/106; 441/108; 2/456; 2/463; 2/464; 2/465; 2/2.11; 2/2.14; 2/468; 2/60; 2/252; 2/69; 2/69.5; 2/92; 2/102; 2/108; 2/126

(58) Field of Classification Search ..... 2/456, 2/463–465, 2.11, 2.14, 468, 60, 252, 69, 2/69.5, 92, 102, 108, 126, DIG. 3; 441/87, 441/88, 102, 94, 106, 108
See application file for complete search history.

(56) References Cited

U.S. PATENT DOCUMENTS

| | | | | |
|---|---|---|---|---|
| 5,781,936 | A * | 7/1998 | Alaloof | 2/456 |
| 6,270,386 | B1 * | 8/2001 | Visocekas | 441/80 |
| 6,298,487 | B1 * | 10/2001 | Mayhew | 2/108 |
| 2005/0279559 | A1 * | 12/2005 | Thevenot | 180/271 |

* cited by examiner

*Primary Examiner*—Patricia M Bianco
*Assistant Examiner*—Nihir Patel
(74) *Attorney, Agent, or Firm*—John W. Carpenter

(57) ABSTRACT

A jacket and method for surviving an avalanche. The method includes inflating an expandable member to generally encapsulate a head of a person. The jacket may comprise a pair of expandable members disposed in pockets of the jacket, and a canister communicating with one of the expandable members. Apparel comprising an inflated expandable member having a depending inflated portion that at least partly covers another inflated expandable member.

13 Claims, 15 Drawing Sheets

JACKET AND METHOD FOR SURVIVING AN AVALANCHE

BACKGROUND OF THE INVENTION

1. Field of Invention

The present invention relates in general to apparel, such as a jacket. More specifically, embodiments of the present invention relate to a jacket and a method for surviving an avalanche.

2. Description of the Background Art

Many winter-outdoor people (e.g. skiers, snow mobilers, hikers, etc) venture into mountainous areas that are susceptible to avalanches. At times these people become trapped underneath snow from an avalanche. While they often have transceivers to inform a search party where they are underneath the snow, they are not equipped to survive under the snow. Therefore, it would be desirable to have a device that allows one to survive an avalanche.

SUMMARY OF EMBODIMENTS OF THE INVENTION

Embodiments of the present invention provide a method for surviving an avalanche comprising inflating a first expandable member to generally encapsulate a head of a person.

Embodiments of the present invention also provide apparel comprising a clothing member to be worn by a user, a first expandable member disposed in a first pocket of the clothing member, at least one expandable second member disposed in at least one second pocket of the clothing member, and a canister communicating with the first expandable member.

Embodiments of the present invention also provide apparel comprising an inflated first expandable member having a depending inflated portion, and at least one inflated second expandable member at least partly covered by the depending inflated portion.

These provisions together with the various ancillary provisions and features which will become apparent to those artisans possessing skill in the art as the following description proceeds are attained by devices, assemblies, systems and methods of embodiments of the present invention, various embodiments thereof being shown with reference to the accompanying drawings, by way of example only, wherein:

DETAILED DESCRIPTION OF EMBODIMENTS OF THE INVENTION

In the description herein for embodiments of the present invention, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Figure 1:
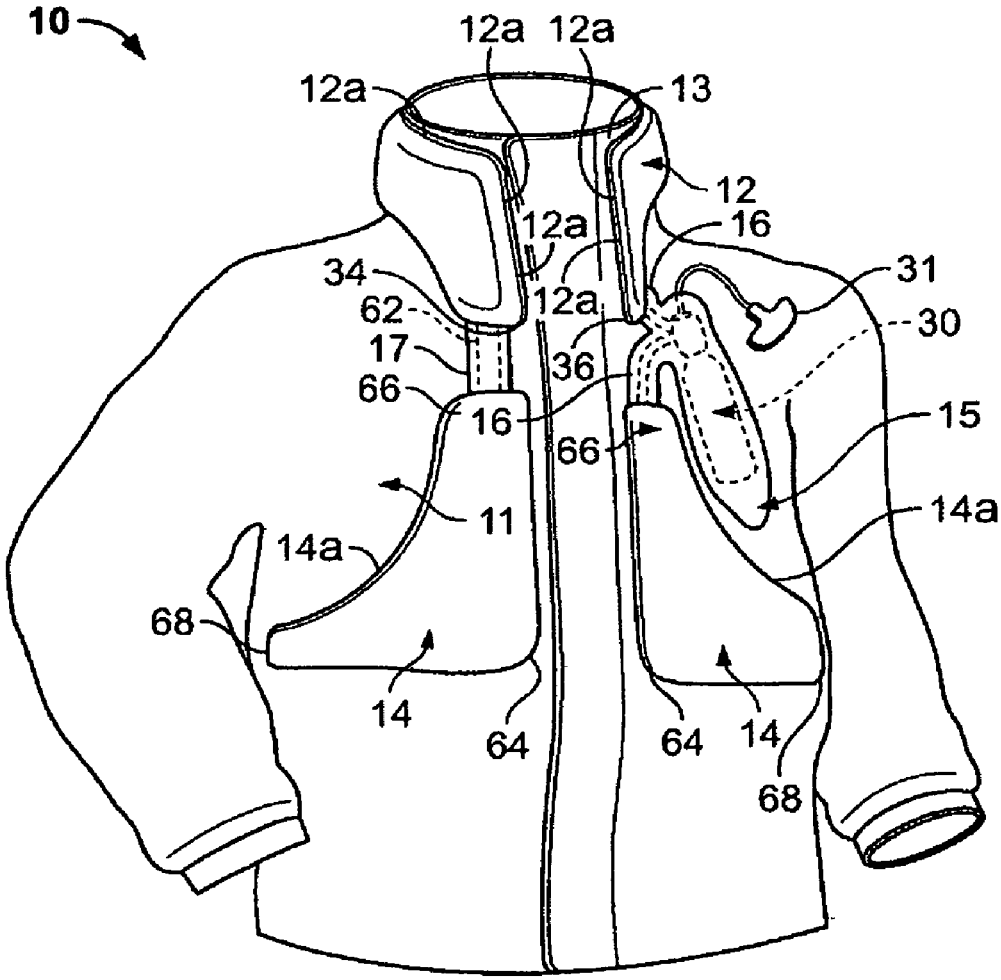
FIG. 1 is a front elevational view of an embodiment of the jacket including a collar having the inflatable member (e.g., an air bag).
Figure 2:
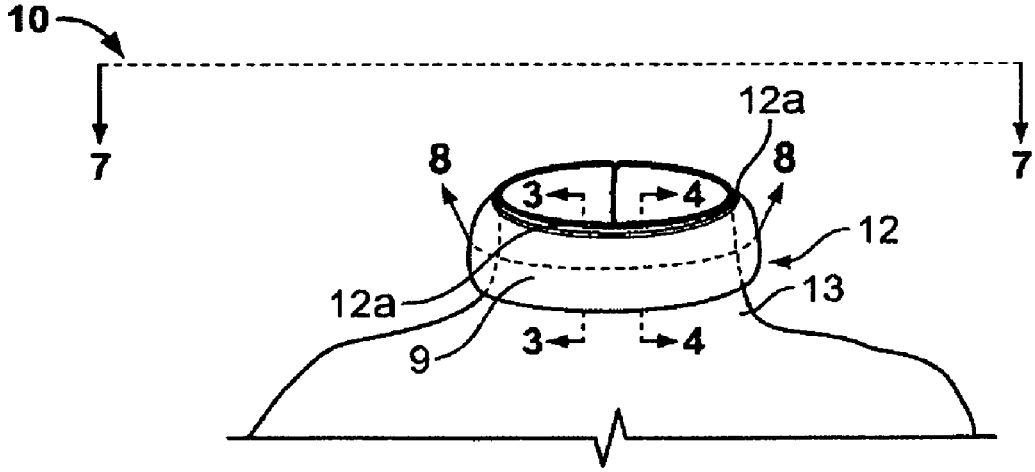
FIG. 2 is a rear elevational view of the embodiment of the jacket of FIG. 1.

Referring in detail now to the drawings, there is seen in FIG. 1 a jacket 10 having a neck 13 and a chest section 11, and further having a neck pocket 12 secured to neck 13, a pair of chest pockets 14-14 secured to chest section 11, and a canister pocket 15 also secured to chest section 11 and communicating with a pair of hose pockets 16-16 that extend to the neck pocket 12 and one of the chest pockets 14. The neck pocket 12 has a releasable seam 12*a* formed by the mating of edges 8*a* and 9*a* of an inner collar layer 8 and an outer collar layer 9. It is to be understood that the "inner collar layer 8" may be the layer of material forming the neck itself. Thus, the inner collar layer 8 means and represents either a layer separate from the layer of material forming the neck 13, or the layer of material itself forming the neck 13. If the inner collar layer 8 is a layer of material separate from the material forming the neck 13, embodiments of the invention would comprise three layers of materials, i.e., the inner collar layer 8, the outer collar layer 9, and the material forming the neck 13. If the inner collar layer 8 is the layer of material forming the neck 13, embodiments of the invention would comprise two layers of materials, i.e., the outer collar layer 9 and the material (i.e., now being the inner collar layer 8) forming the neck 13. Either of the embodiments of the invention furnishes the pocket 12 for an air bag (i.e., an expandable member) 20 that is capable of expanding when receiving air, or any other gaseous non-toxic/human compatible matter, from a canister 30.

Figure 3:
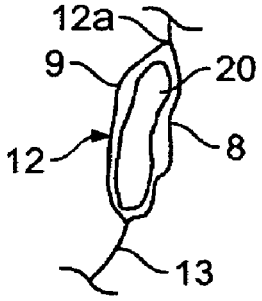
FIG. 3 is a vertical sectional view taken in direction of the arrows and along the plane of line 3-3 in FIG. 2.
Figure 4:
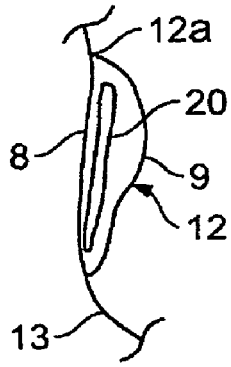
FIG. 4 is a vertical sectional view taken in direction of the arrows and along the plane of line 4-4 in FIG. 2.
Figure 5:
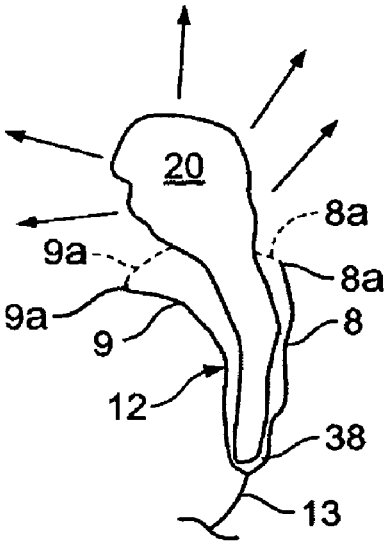
FIG. 5 is a front elevational view of the collar in FIG. 3 after the neck air bag has begun to expand and released or severed the releasable seam, breaking the top of the outer collar layer away from the inner collar layer.
Figure 6:
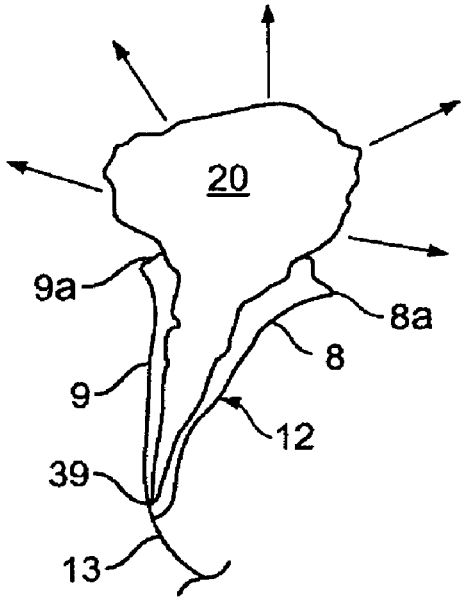
FIG. 6 is a front elevational view of the collar in FIG. 5 after the neck air bag has expanded further from its position in FIG. 5.
Figure 7:
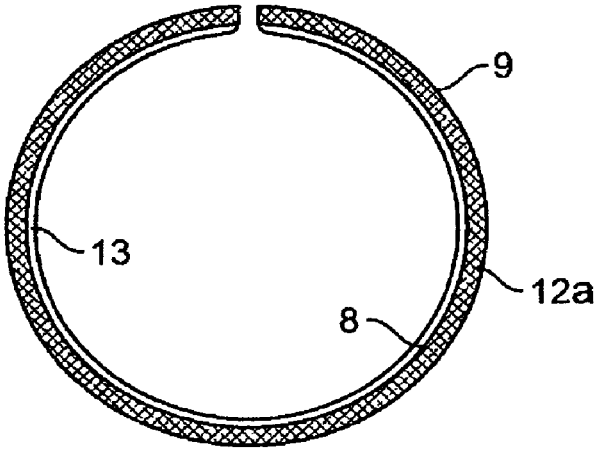
FIG. 7 is a top plan view taken in direction of the arrows and along the plane of line 7-7 in FIG. 2.
Figure 8:
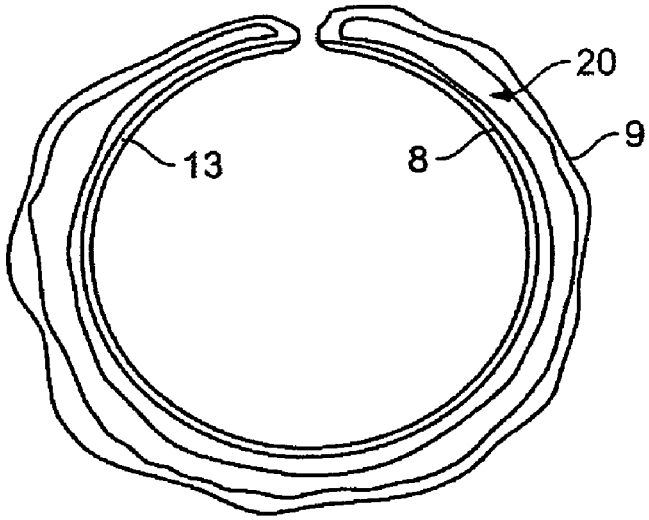
FIG. 8 is a horizontal sectional view taken in direction of the arrows and along the plane of line 8-8 in FIG. 2.

The releasable seam 12*a* formed by the mating of edges 8*a* and 9*a* of the inner collar layer 8 and the outer collar layer 9 may be any suitable seam that is capable of severing or braking free when the air bag 20 commences to inflate. A suitable releasable seam 12*a* may be one formed with Velcro® fastening materials. The releasable seam 12*a* would typically extend from point 34 on one front edge to around the neck 13 and then terminating at point 36 on another front edge in FIGS. 1 and 9. Referring now to FIGS. 5 and 6, there is seen in FIG. 5 a front elevational view of the collar 13 in FIG. 3 after the air bag 20 has begun to expand and release or severe the releasable seam 12*a*, breaking the top and front edge of the outer collar layer 9 away from the top and front edge of the inner collar layer 8. FIG. 6 is a front elevational view of the collar 13 in FIG. 5 after the air bag 20 has expanded further from its position in FIG. 5. The air bag 20 is preferably anchored within the pocket 12, such as by connecting to inner layer 8 at point 38 in FIG. 5 or by connecting to outer layer 9 at point 39 in FIG. 6. After the air bag 20 finishes expanding, it will have the appearance of the fully expanded air bag in FIGS. 18-20.

Each of the chest pockets 14-14 has a releasable seam 14*a* formed by the mating of edges 42*a* and 44*a* of an inner chest layer 42 and an outer chest layer 44. It is to be understood that the "inner chest layer 42" may be the layer of material forming the chest 11. Thus, the inner chest layer 42 means and represents either a layer separate from the layer of material forming the chest 11, or the layer of material itself forming the chest 11. If the inner chest layer 42 is a layer of material separate from the material forming the chest 11, embodiments of the invention would comprise three layers of materials, i.e., the inner chest layer 42, the outer chest layer 44, and the material forming the chest 11. If the inner chest layer 42 is the layer of material forming the chest 11, embodiments of the invention would comprise two layers of materials, i.e., the outer chest layer 44 and the material (i.e., now being the inner chest layer 42) forming the chest 11. Either of the embodiments of the invention furnishes the two pockets 14-14, each of which includes an air bag (i.e., an expandable member) 50 that is capable of expanding when receiving air, or any other gaseous non-toxic/human compatible matter, from a canister 30. Thus, for an embodiment of the invention, there are two air bags 50-50. The hoses 54 and 58 respectively lodge in one of the hose pockets 16-16 which communicate with the canister pocket 15 housing the canister 30. The hose pockets 16-16 as well as the canister pocket 15 may be on the inside or the outside of the jacket 10, preferably on the outside. Hose 62 as best shown in FIG. 1 may be housed by hose pocket 17 which also may be on the inside or the outside of the jacket 10. Each of the air bags 50 may be anchored or attached to the inside surface of one of layers forming their respective pocket 14.

Figure 10:
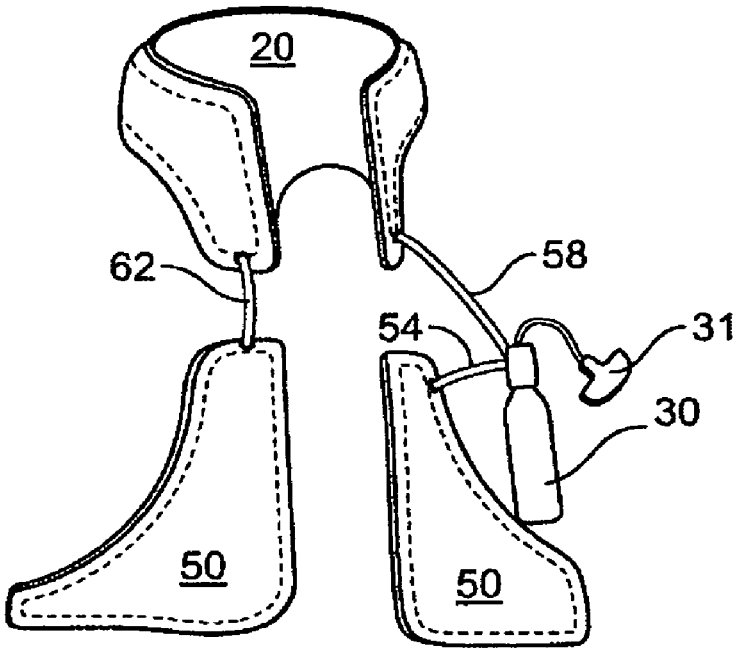
FIG. 10 is a front elevational view of the neck air bag and the chest air bags coupled by hoses to an air container having a handle which when pulled, releases air into the air bags.

The air canister 30 communicates with the air bags 20 and 50-50 in any suitable pneumatic sequence. Thus, air may flow into air bags 20 and 50-50 via any suitable sequence. By way of example only, air may flow from canister 30 into all three bags 20 and 50-50 simultaneously, or air may flow initially from the canister 30 into bags 50-50 and then into bag 20 from bags 50-50. In an embodiment of the invention and as best illustrated in FIG. 10, after tab 31 is pulled by a user of the jacket 10, air is initially simultaneously released from the canister 30 into one of the air bags 50 and into air bag 20 via hoses 54 and 58, respectively, and then air flows subsequently from air bag 20 into the remaining air bag 50 via hose 62. The air bags 20 and 50-50 may be manufactured from any suitable material, preferably a material of sufficient elasticity and strength (e.g., a rubber or elastic composite) to provide for readable expansion and strength to protect the user. The air canister 30 may be any suitable air canister such as that sold under the OxyMatic 300 Series by Tri-Med, Inc., of Aurora Co.

Figure 9:
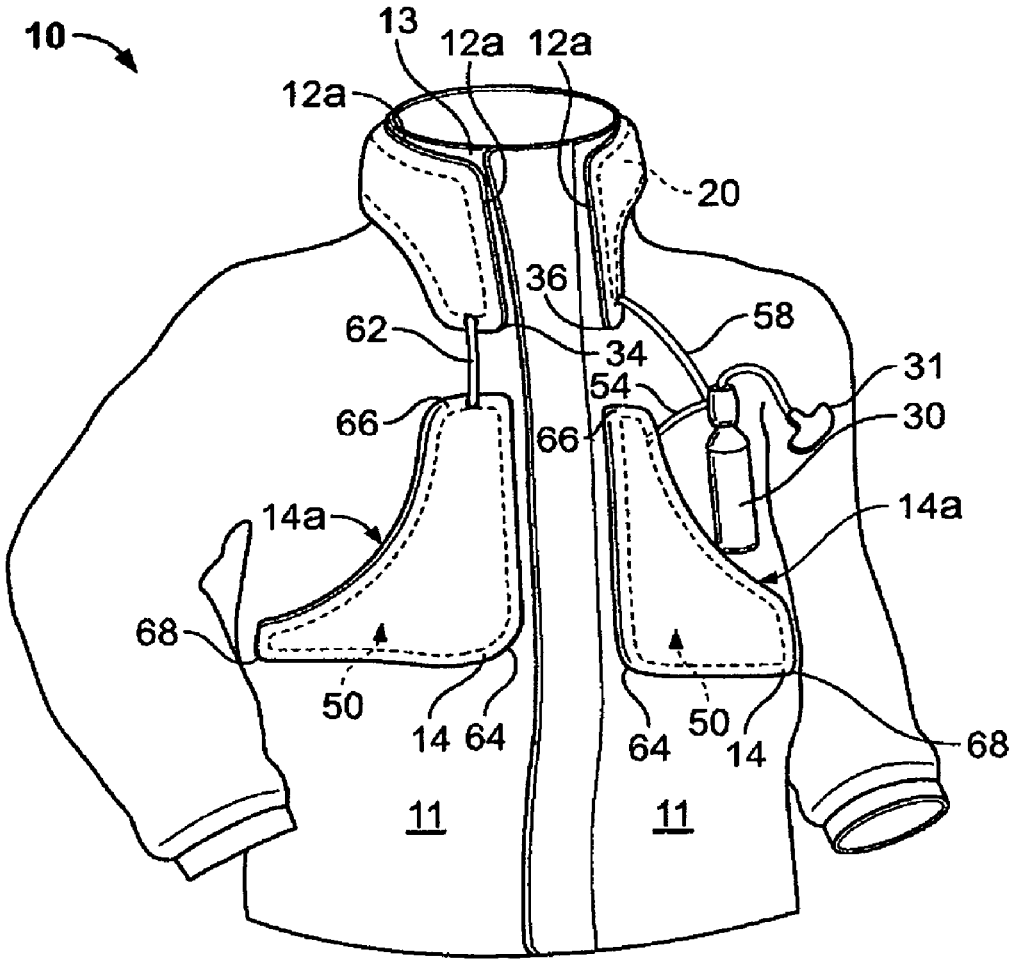
FIG. 9 is a front elevational view of the embodiment of the jacket of FIG. 1 with the air container and its associated hoses not located in the chest pocket of the jacket.
Figure 21:
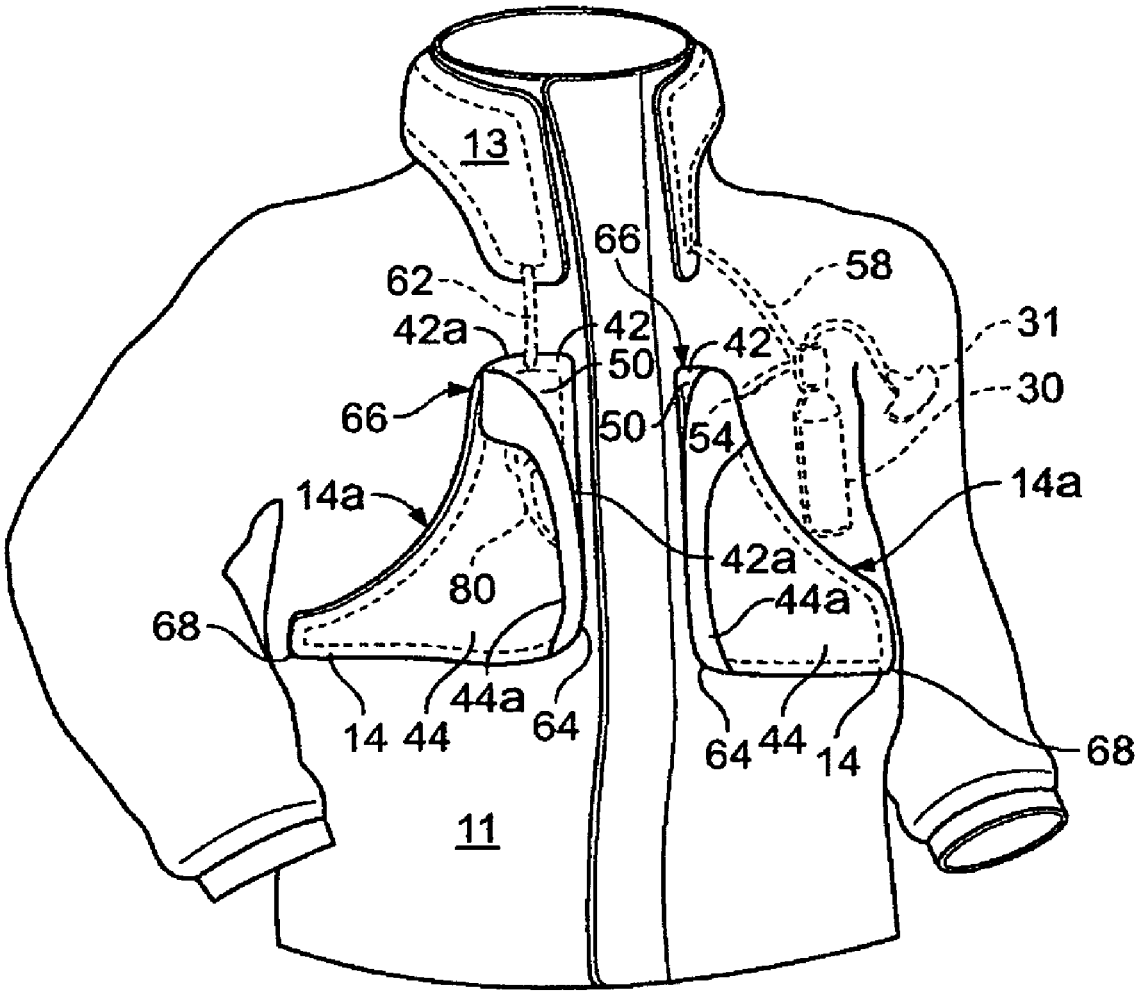
FIG. 21 is a front elevational view of the chest of the jacket after both chest air bag within the two chest pockets have begun to expand and have released or severed the releasable side seam, breaking the side seam of each chest pocket such that outer chest layer of each chest pocket breaks away from the inner chest layer of each chest pocket.

The releasable seam 14*a* formed by the mating of edges 42*a* and 44*a* of the inner chest layer 42 and the outer chest layer 44 may be any suitable seam that is capable of severing or braking free when the air bags 50-50 commence to inflate. A suitable releasable seam 14*a* may be one formed with Velcro® fastening materials. The releasable seam 14*a* would typically extend upwardly from point 64 of a front edge, around section 66, and then downwardly terminating at point 68 on another front edge, as best shown in FIGS. 1, 9 and 21.

Figure 22A:
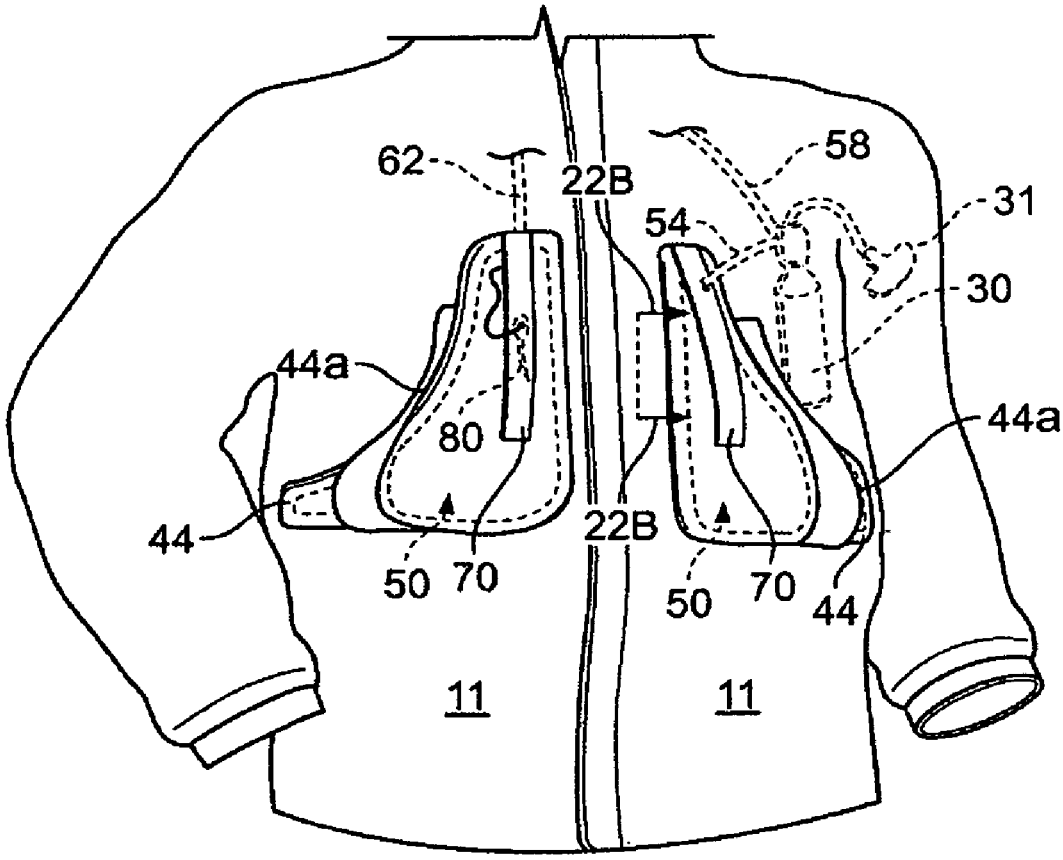
FIG. 22A is a front elevational view of the chest of the jacket in FIG. 21 after the chest air bags have expanded further from partially expanded position in FIG. 21.
Figure 22B:
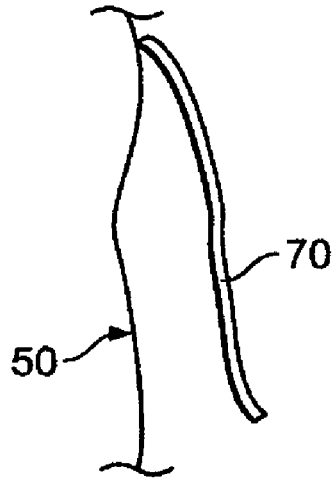
FIG. 22B is a horizontal view of an expanded chest air bag taken in direction of the arrows and along the plane of line 22B-22B in FIG. 22A, showing a handle spaced from the top surface of the expanded chest air bag.
Figure 23:
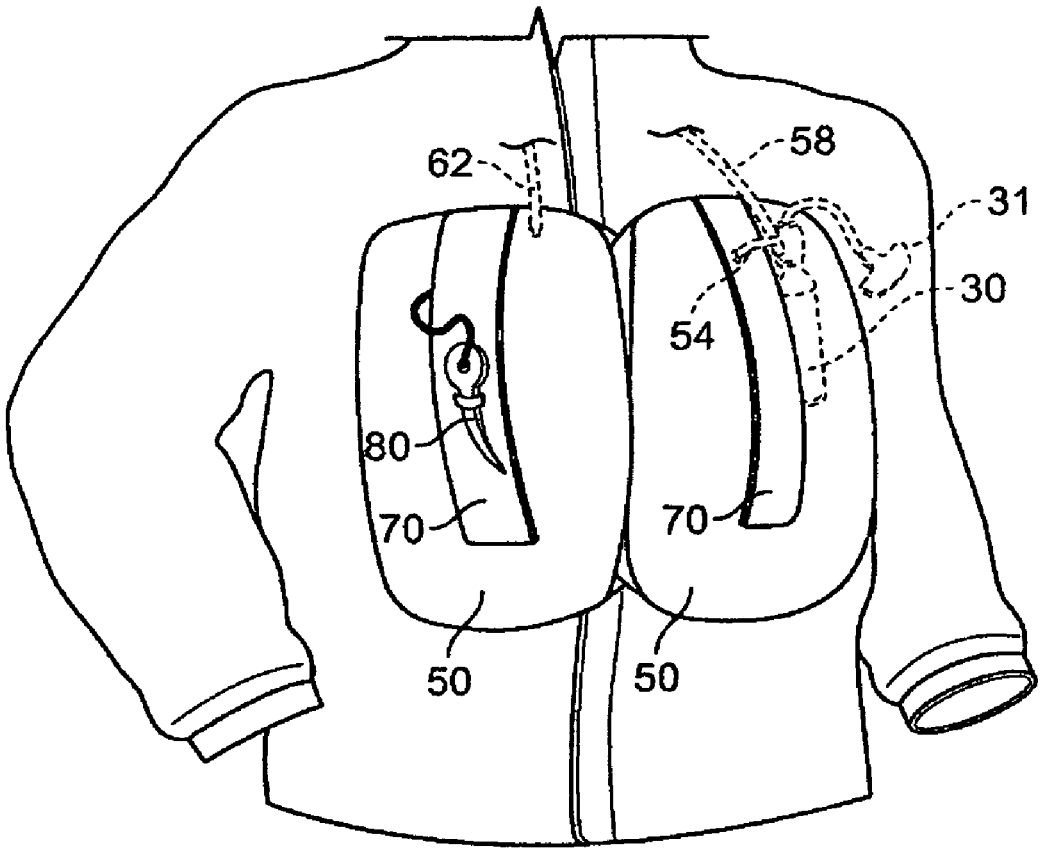
FIG. 23 is a front elevational view of the chest of the jacket in FIG. 22 after the chest air bags have completely expanded (i.e., expanding further from their partially expanded position in FIG. 22) and disclosing each of the expanded chest air bags having a handle and with one of the handles engaged to a scraper.
Figure 24:
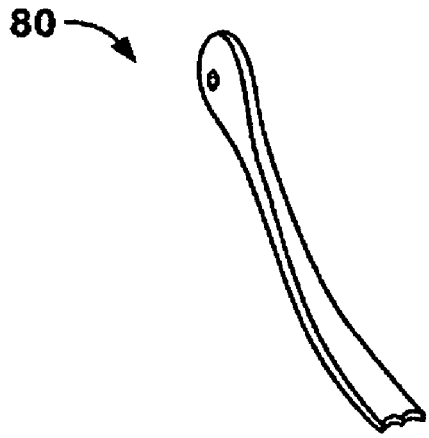
FIG. 24 is a front elevational view of the scraper.

Referring again now to FIG. 21, there is seen a front elevational view of the chest 11 of the jacket 10 after both chest air bags 50-50 within the two chest pockets 14-14 have begun to expand and have commenced releasing or severing the releasable seam 14*a*, breaking the inner side portion of releasable seam 14*a* of each chest pocket 14 such that outer chest layer 44 of each chest pocket 14 breaks away from the inner chest layer 42 of each chest pocket 44. FIG. 22A is a front elevational view of the chest 11 of the jacket 10 in FIG. 21 after the chest air bags 50-50 have expanded further from their partially expanded position in FIG. 21. FIG. 23 is a front elevational view of the chest 11 of the jacket 10 in FIG. 22 after the chest air bags 50-50 have completely expanded (i.e., expanding further from their partially expanded position in FIG. 22). Each of the chest air bags 50 may be conveniently fitted with a handle 70 that hangs freely so the user may grab it with a hand in the event of an avalanche to assist in keeping the arms close to the body such that the arms do not become pinned by snow after a person finishes tumbling in the snow of an avalanche. Centrifugal force from tumbling causes the arms to have a tendency to swing outwardly and away from the body. FIG. 22B is a horizontal view of an expanded chest air bag 50 taken in direction of the arrows and along the plane of line 22B-22B in FIG. 22A, showing a handle 70 made of any suitable material (e.g., canvas, etc) and secured at one end to and spaced from the top surface of the expanded chest air bag 50. One or both of the chest air bags 50 may removably hold a scraper 80. FIG. 24 is a front elevational view of the scraper 80.

Figure 14:
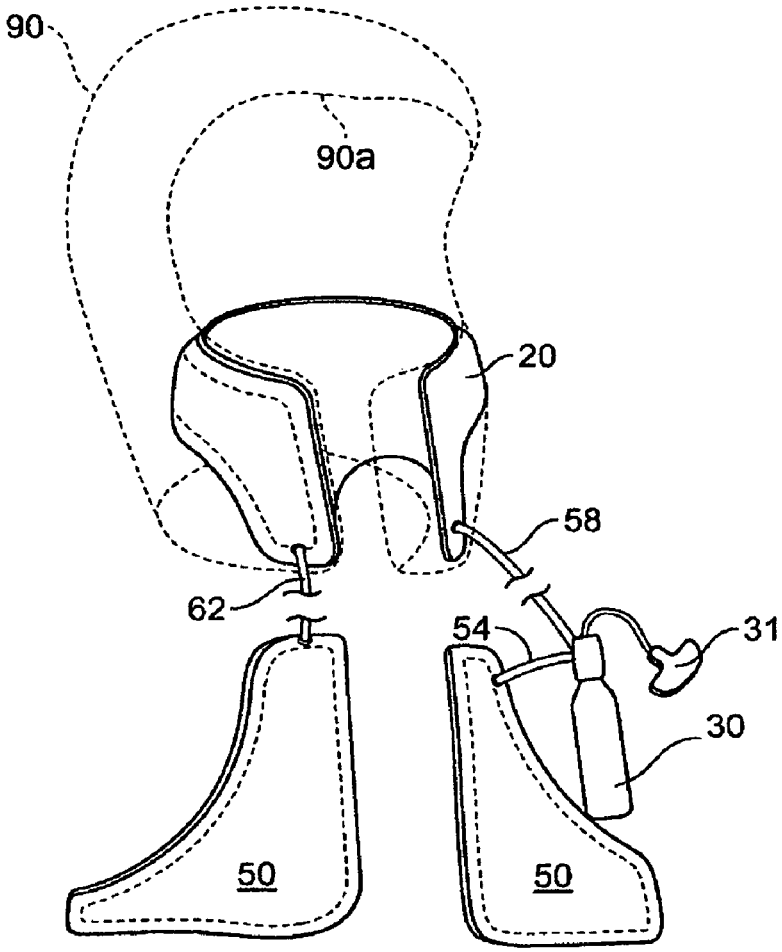
FIG. 14 is a front elevational view of another embodiment of the jacket including a hood having the inflatable member (e.g. an air bag).
Figure 15:
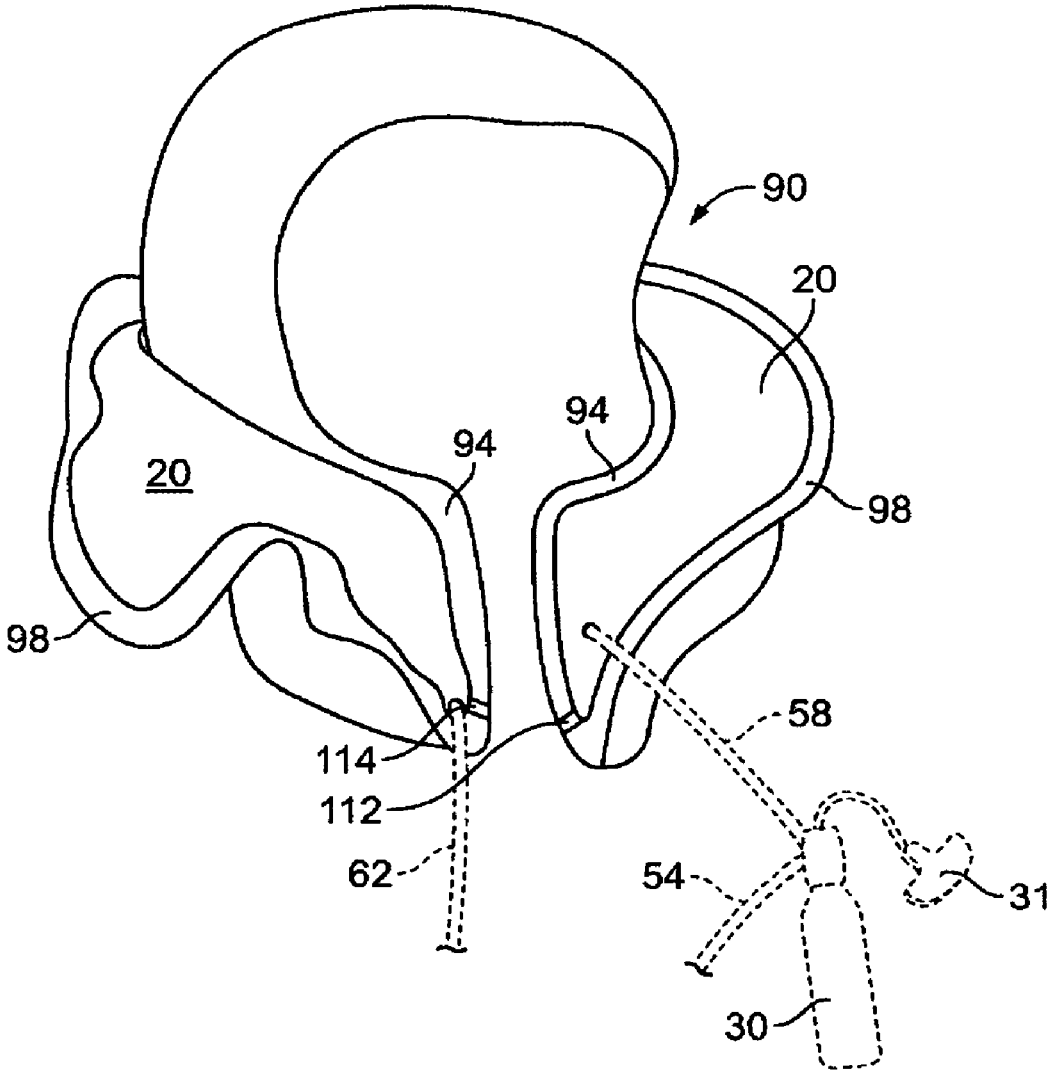
FIG. 15 is a front elevational view of the hood of the jacket in FIG. 14 after the hood air bag has begun to expand and released or severed the releasable seam, breaking the front seam of the outer hood layer away from the inner hood layer.

In another embodiment of the invention as best illustrated in FIGS. 11-17, the air bag 20 is located in a jacket hood, generally illustrated as 90. The jacket hood 90 has a releasable seam 90*a* formed by the mating of edges 94*a* and 98*a* of an inner hood layer 94 and an outer hood layer 98. It is to be understood that the "inner hood layer 94" may be the layer of material forming the hood itself. Thus, the inner hood layer 94 means and represents either a layer separate from the layer of material (e.g., material 95) forming the hood 90, or the layer of material itself forming the hood 90. If the inner hood layer 94 is a layer of material separate from the material forming the hood 90, embodiments of the invention would comprise three layers of materials, i.e., the inner hood layer 94, the outer hood layer 98, and the material 95 forming the hood 90. If the inner hood layer 94 is the layer of material forming the hood 90, embodiments of the invention would comprise two layers of materials, i.e., the outer hood layer 98 and the material (i.e., now being the inner hood layer 94) forming the hood 90. Either of the embodiments of the invention furnishes a hood pocket 100 for the air bag 20. The air bag 20 may be anchored (e.g., at 112 and 114) as shown in FIG. 15 to the inside surface of one of the layers forming the hood pocket 100.

Figure 11:
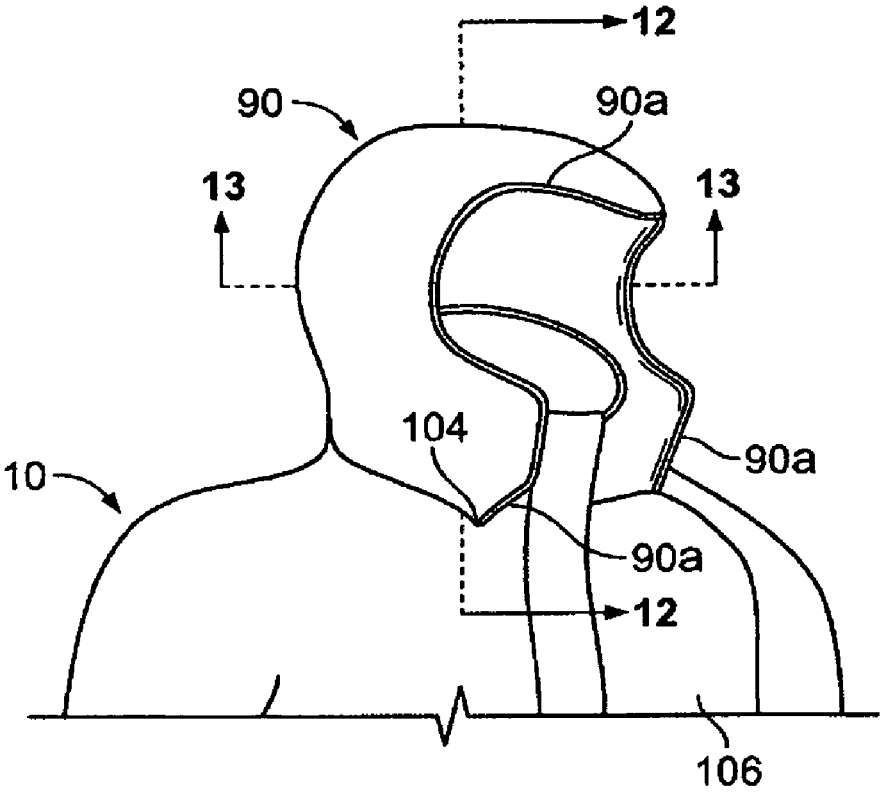
FIG. 11 is a front elevational view of another embodiment of the invention wherein a hood of the jacket contains a hood air bag which communicates with an air container.
Figure 12:
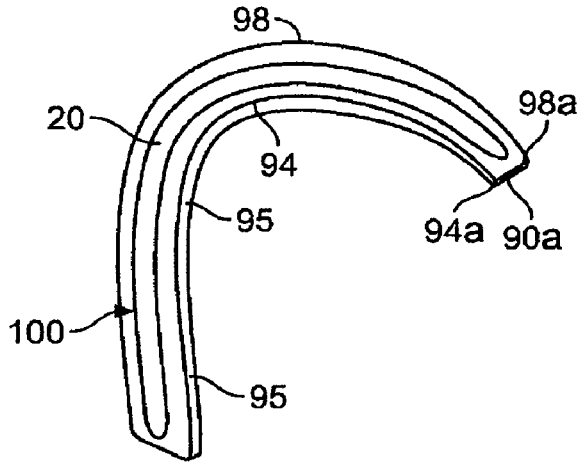
FIG. 12 is a vertical sectional view taken in direction of the arrows and along the plane of line 12-12 in FIG. 11.
Figure 13:
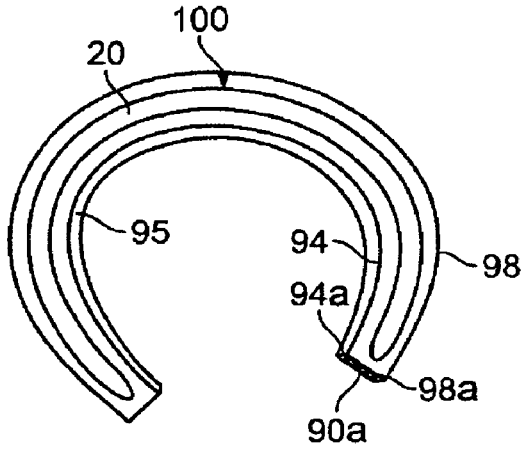
FIG. 13 is a vertical sectional view taken in direction of the arrows and along the plane of line 13-13 in FIG. 11.

The releasable seam 90*a* formed by the mating of edges 94*a* and 98*a* of the inner hood layer 94 and the outer layer 98 may be any suitable seam that is capable of severing or braking free when the air bag 20 commences to inflate. A suitable releasable seam 90*a* may be one formed with Velcro® fastening materials, and could typically extend from point 104 on one front edge to around the hood 90 (circumscribing the face of the user) and then terminating at point 106 on another front edge, as shown in FIG. 11.

Figure 16:
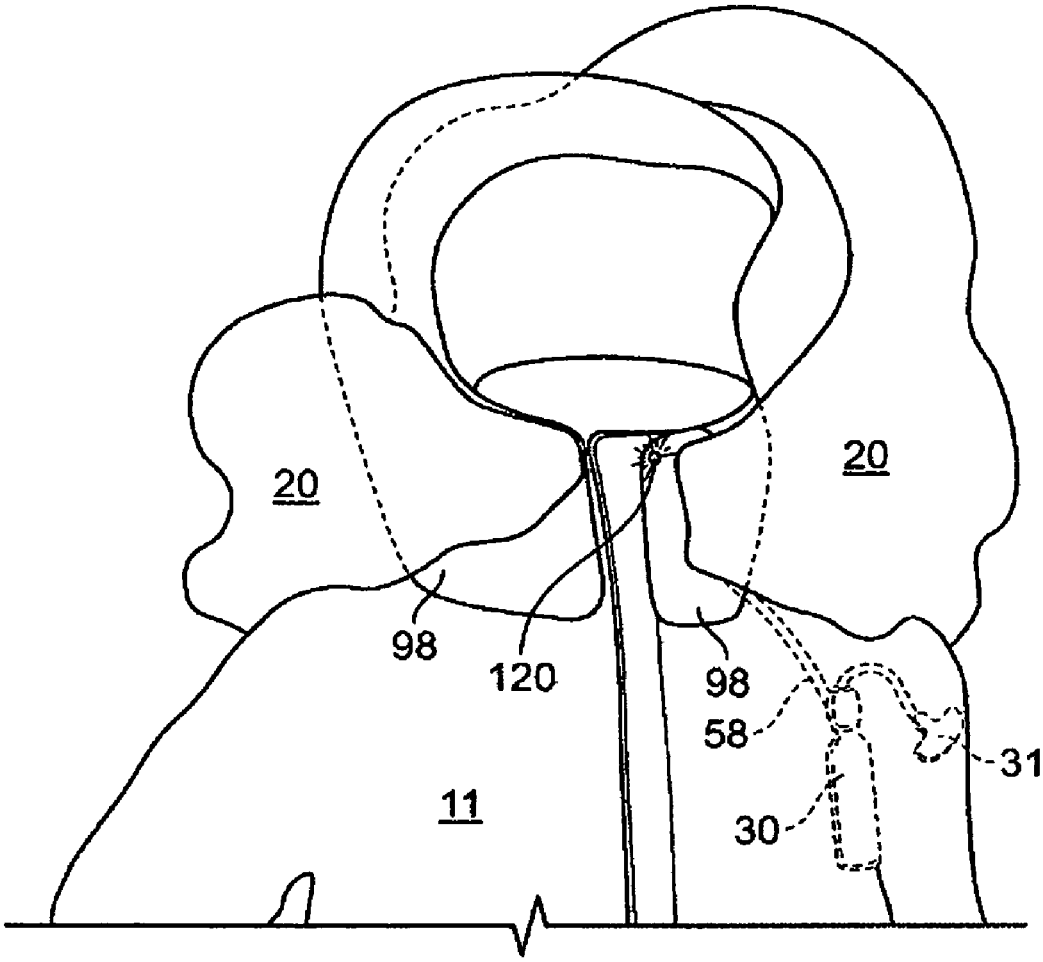
FIG. 16 is a front elevational view of the hood in FIG. 15 after the hood air bag has expanded further from its position in FIG. 15 and disclosing an illuminated LED light.
Figure 17:
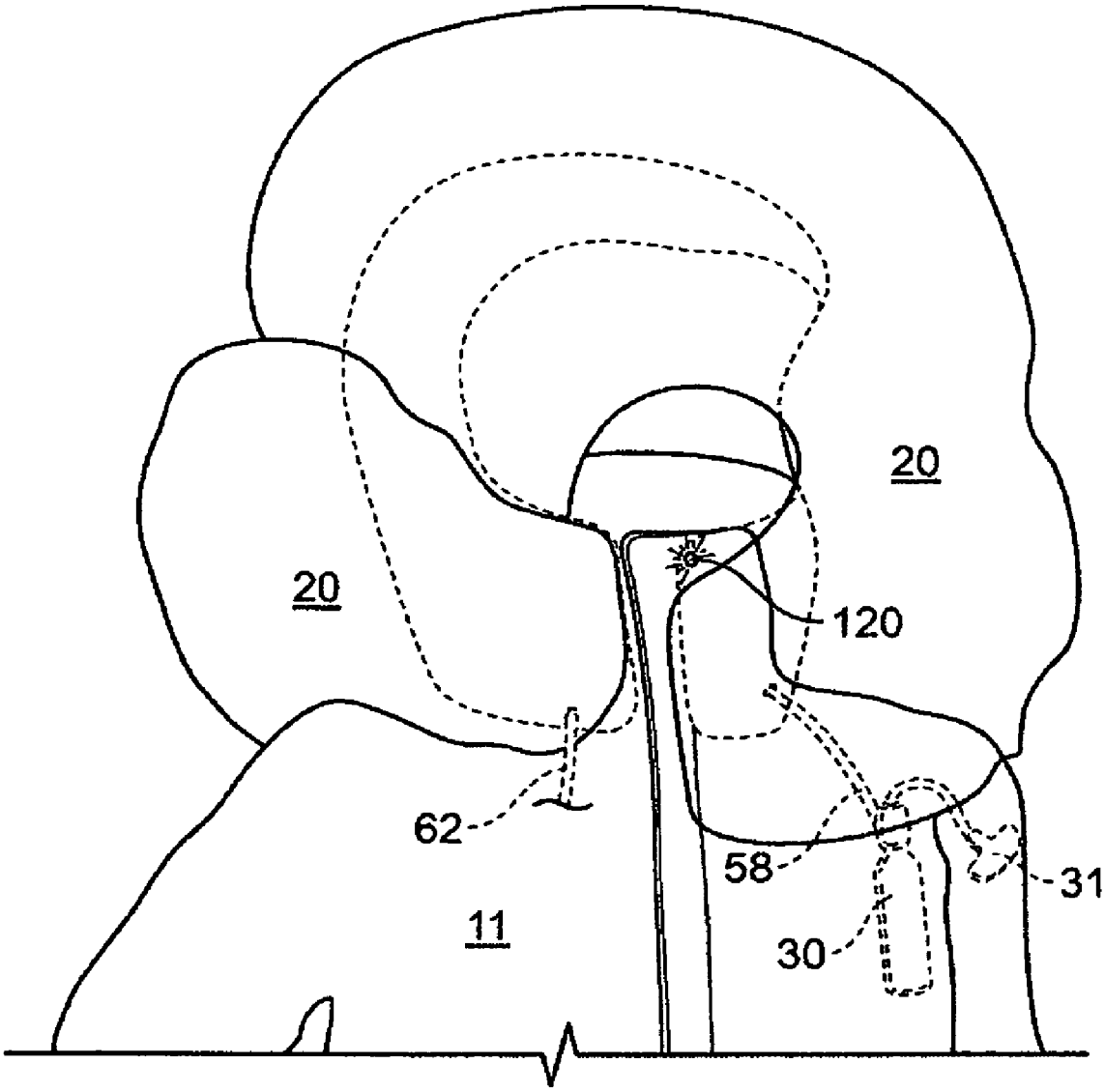
FIG. 17 is a front elevational view of the hood in FIG. 16 after the hood air bag has almost completely expanded (i.e., expanding further from its position in FIG. 16) and disclosing the illuminated LED light.

Referring now to FIGS. 15-17, FIG. 15 is a front elevational view of the hood 90 of the jacket 10 in FIG. 14 after the air bag 20 has begun to expand and release or severe the releasable seam 90*a*, breaking the front seam of the outer hood layer 98 away from the inner hood layer 94. FIG. 16 is a front elevational view of the hood 90 in FIG. 15 after the air bag 20 has expanded further from its position in FIG. 15. An illuminated LED light 120 is also illustrated in FIG. 16. FIG. 17 is a front elevational view of the hood 90 in FIG. 16 after the air bag 20 has almost completely expanded (i.e., expanding further from its position in FIG. 16) and disclosing the illuminated LED light 120.

Figure 18:
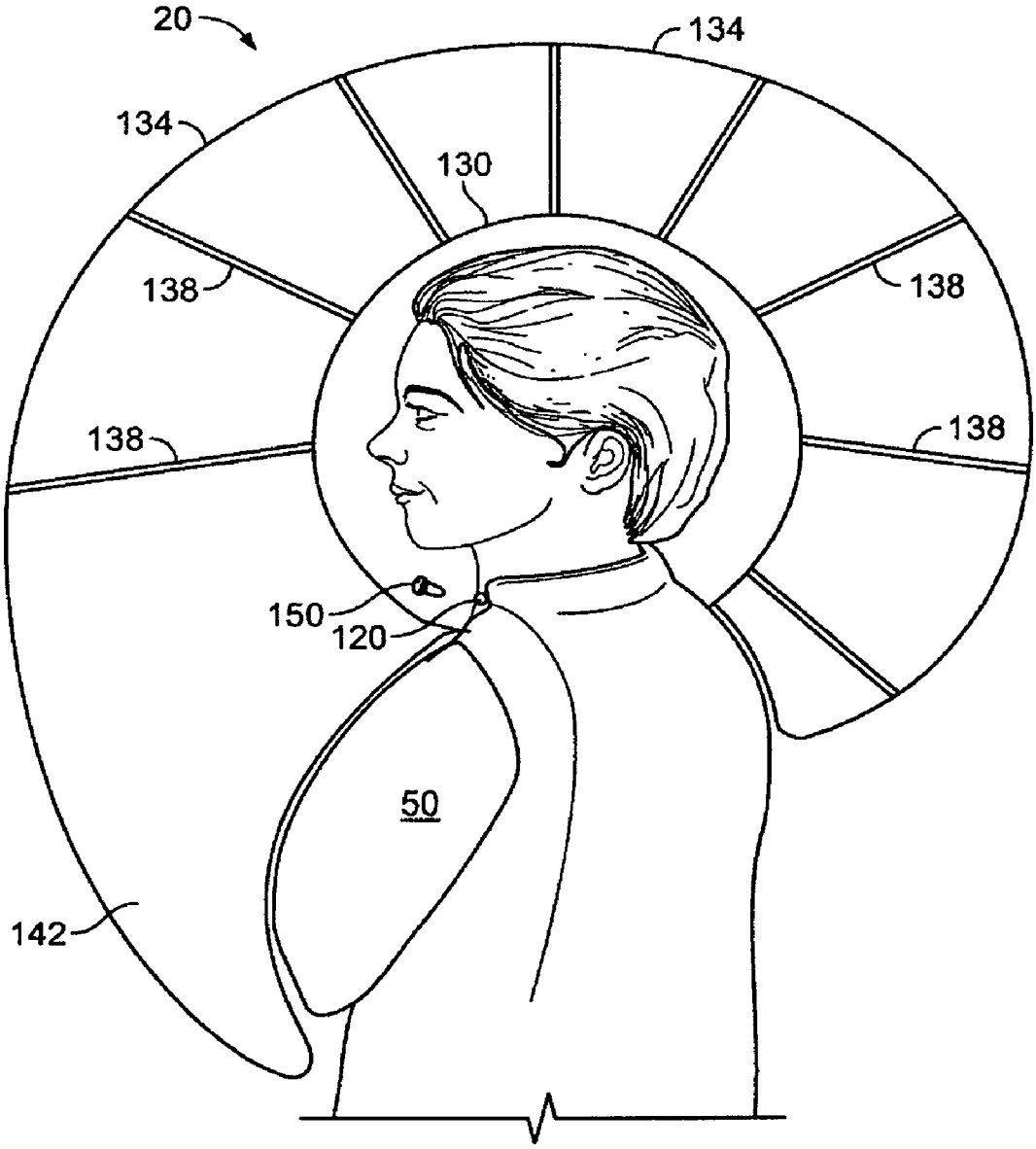
FIG. 18 is a partial sectional view of the air bag surrounding a head of a person and showing a plurality of web members which couple an inner air-bag layer to an outer air-bag layer to prevent the air bag from collapsing inwardly onto the head and further showing a section of the air bad extending downwardly and covering the pair chest air bags.
Figure 19:
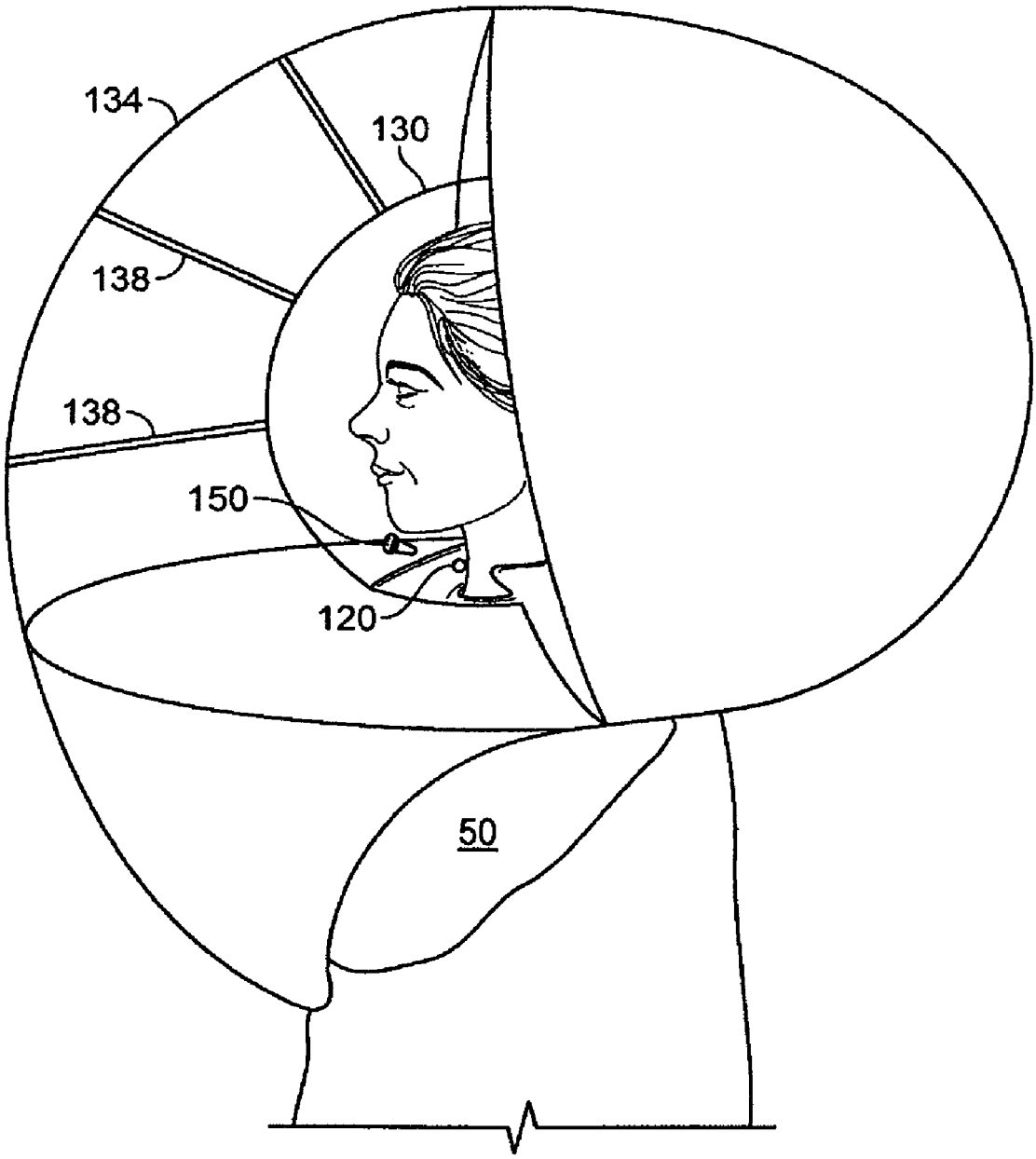
FIG. 19 is a side elevational view of the air bag surrounding a head of a person and showing a transparent section and a plurality of web members which couple an inner air-bag layer to an outer air-bag layer to prevent the air bag from collapsing inwardly onto the head and further showing a section of the air bad extending downwardly and covering the pair chest air bags.
Figure 20:
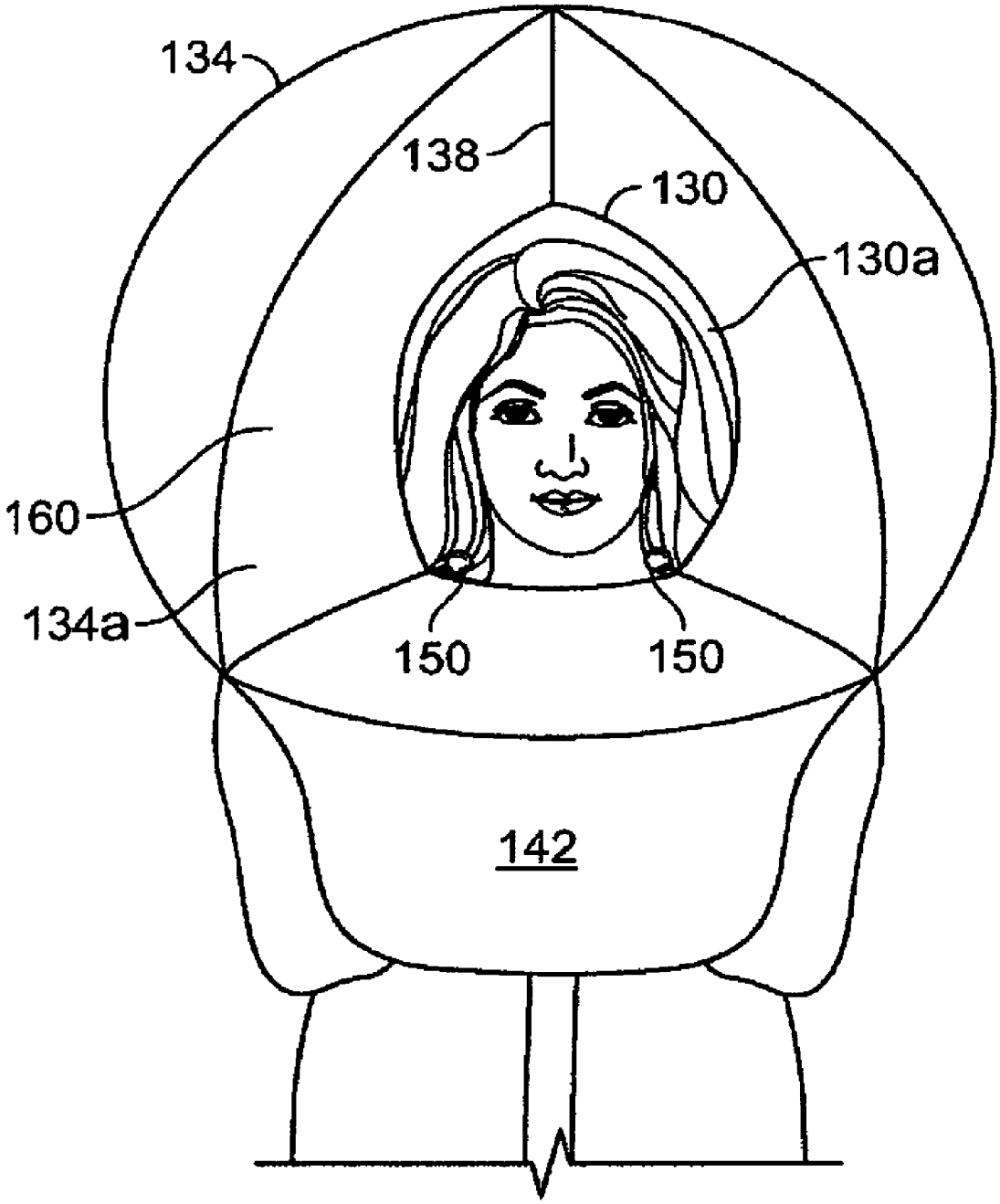
FIG. 20 is a front elevational view of the air bag surrounding a head of a person and showing a transparent section and a plurality of web members which couple an inner air-bag layer to an outer air-bag layer to prevent the air bag from collapsing inwardly onto the head and further showing a section of the air bag extending downwardly and covering the pair of chest air bags.

After the air bag 20 finishes expanding (either after expanding from within the neck pocket 12 of the collar 13 or from within the hood pocket 100 of the hood 90), it will have the appearance of the fully expanded air bag 20 in FIGS. 18-20. The expanded air bag 20 has an inner air bag layer 130 spaced from the face of the user, and an outer air bag layer 134 coupled to the inner air bag layer 130 by web members 138 which maintains a generally constant thickness for the expanded air bag 20 and keeps the inner air bag layer 130 away from the head of the user. The air bag 20 has suitable air release valves 150 in proximity to the mouth of the user. The air release valves 150 slowly release a suitable quantity of air in order to prevent the user from suffocating. The expanded air bag 20 slowly commences to deflate as air is being slowly released from the expanded air bag 20 through the air valves 150. It has been discovered that air pressure within the air bags 20 and 50-50 should range from about 0.5 psi to about 10 psi, more preferably from about 3.0 psi to about 9 psi, most preferably from about 5.0 psi to about 7.0 psi (e.g., about 6 psi). The air valves 150-150 may be any suitable air valves such as the pressure relief valves sold by Halkey Roberts Corp of St. Petersburg, Fla.

Figure 26:
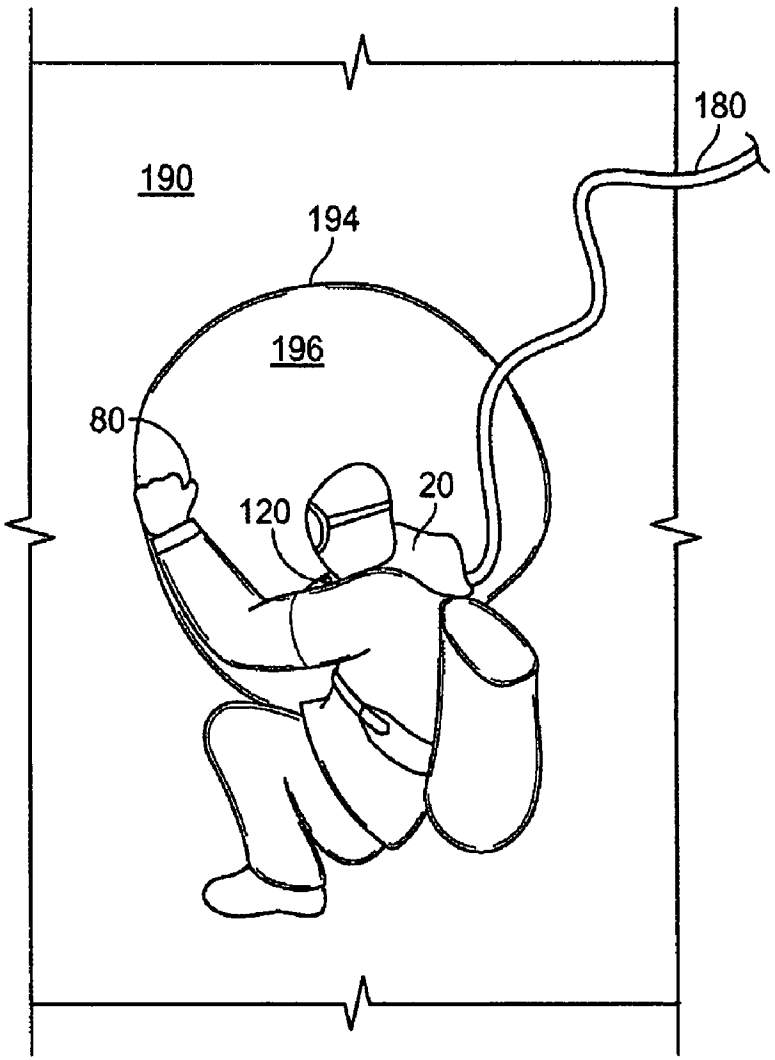
FIG. 26 is an elevational view of the person in FIG. 25 after the air bags have all been deflated from air leaving the respective air bags, and showing the person using the scraper to remove frozen ice within a cavern and having an illuminated LED and the fluorescent tassel or line extending from the person to the top of the snow.
Figure 25:
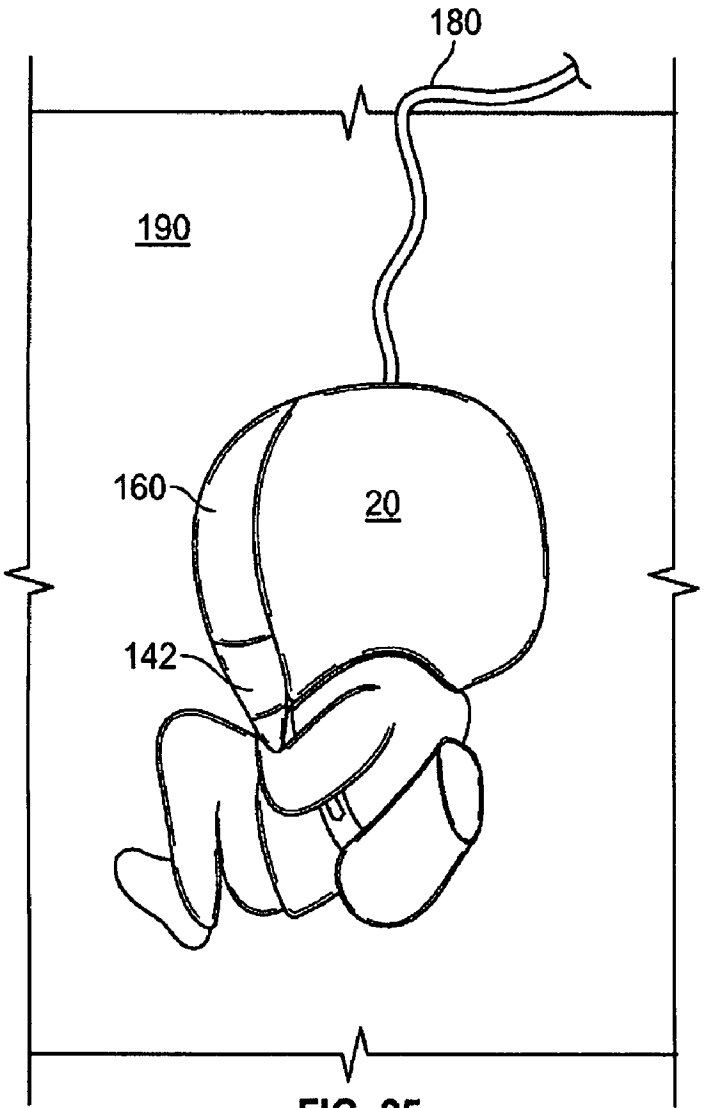
FIG. 25 is an elevational view showing a person covered with snow from an avalanche and having a fluorescent tassel or line extending from the person to the top of the snow.

The air bag 20 is preferably formed with a transparent section 160 (i.e., the inner air bag layer 130 and the outer air bag layer 134 respectively have transparent sections 130*a* and 134*a*) so the user may see to prevent a claustrophobic experience. The expanded air bag 20 may include a depending section 142 which extends downwardly over the expanded air bags 50-50 to protect the hands of the user when the user is holding handles 70-70. As best shown in FIGS. 25 and 26, a fluorescent line, ribbon or tassel 180 may be coupled to the user (e.g., connected to air bag 20) so when air bag 20 expands, the tassel 180 is released and may extend to the surface of snow 190. Continuing to refer to FIGS. 25 and 26, FIG. 25 is an elevational view showing a person covered with snow 190 from an avalanche and having the fluorescent tassel 180 or line extending from the person to the top of the snow 190. FIG. 26 is an elevational view of the person in FIG. 25 after the air bags 20 and 50-50 have all been deflated from air leaving the respective air bags through valves 150, and showing the person using the scraper 80 to remove frozen ice 194 within a cavern 196 and having the illuminated LED 120 and the fluorescent tassel or line 180 extending from the person to the top of the snow 190 where it may be readily seen by rescuers.

Alternatively to using the fluorescent line, ribbon or tassel 180, a dye may be released from any suitable part of the jacket 10, including from the air bags 20 and/or 50-50 (i.e., the inflated, expanded members) to produce a trail of dye. Theoretically, the size of the inflated, expanded member(s) (e.g., the airbag(s)) would have a large enough surface area (i.e., of sufficient volumetric area) to prevent burial. However, as indicated, if the victim somehow does end up buried under the snow 190, he/she is provided with at least an extra 15 minutes of breathing air, such as from about 15 minutes to about 45 minutes. The scraper 80 would enable a person stay under the snow 190 for hours, depending on hypothermic conditions. The scraper 80 functions to remove frozen snow (e.g., a layer of internal ice 194 surrounding the victim) resulting from frozen condensation after exhaling. Typically, exhaled air includes carbon dioxide which contains moisture. As indicated, the fluorescent line, ribbon, or tassel (preferably a red or orange tassel) 180 would be visible on the surface of the snow 190.

As further previously indicated, the inflated, expanded member, expanded air bag 20, has suitable air release valves 150 in proximity to the mouth of the victim. The air release valves 150 slowly release a suitable quantity of air in order to prevent the victim from suffocating. As the air is being slowly released from the inflated, expanded member (expanded air bag 20), the expanded member slowly commences to deflate.

After the victim is covered with snow 190 from the avalanche, the battery powered light 120 (e.g., a small LED powered by a watch battery) located inside the collar 13 of the jacket 10 would subsequently illuminate to provide light for the victim. The cavern 196 of snow 190 that the victim is in would be illuminated to minimize panic from complete darkness. Since avalanche snow typically comprises from about 40% to about 60% by volume air, by chipping away frozen ice 194 with the scraper 80 on the wall 194 of the cavern 196 containing the victim, the victim is able to obtain more air that is commingled with the avalanche snow. A cavern 196 having frozen walls 194 cuts off the air supply from air that is contained in the avalanche snow.

In operation of embodiments of the invention, if an avalanche starts, the person should immediately pull the handle 31 leading to the air canister 30 in order to inflate all of the air bags (i.e., air bags 20 and 50-50). The victim should keep his/her head uphill and attempt to lie face up and backstroke as much as possible. As air bags 20 and 50-50 in the jacket 10 inflate, the head becomes encapsulated within the air bag 20 around the collar 13 or in the hood 190. The air bags 50-50 in the chest area of the jacket 10 expand to protect the chest from the heavy snow, comparable to an air bag in an automobile expanding to protect a person in a car accident. The clear window 160 in the expanded air bag 20 surrounding the head enables a person to see where he/she is.

In further operation of embodiments of the invention, if a person can not "swim out" of the avalanche, then the person should grab the handles 70-70 located on the chest air bags 50-50. This protects the arms of the person until the avalanche stops. If a person has his/her arms extended during an avalanche, the arms may be injured during the avalanche and/or after the avalanche stops, the arms of the person may be pinned down such that the arms are immovable. After the avalanche stops, the person now is not moving from the force of the avalanche and is covered with snow.

Under avalanche snow, air typically has a temperature ranging from about 20° F. to about 35° F. As previously indicated, it has been discovered that the air bags (i.e., the air bag 20 surrounding the head and the air bags 50-50 on the chest) preferably are inflated with breathable air to a pressure ranging from about 0.5 psi to about 10 psi, more preferably from about 3.0 psi to about 9 psi, most preferably from about 5.0 psi to about 7.0 psi (e.g., about 6 psi). It has been discovered that a typical average human being breathes approximately 1,680 cubic inches of air at 6 psi in about 15 minutes. The air chambers (i.e., the air chamber of air bag 20 surrounding the head and the air chambers of the chest air bags 50-50 on the chest 11) include more than about 2,000 cubic inches of air. Since an average of 50% of all people buried in an avalanche are found dead after 15 minutes, embodiments of this jacket 10 can provide enough air to at least double the survival time for a person buried in snow 190 of an avalanche. The average rescue time of people covered with snow 190 from an avalanche is 20 minutes. In combination with the scraper 80, a person buried in snow 190 could live for hours under the snow until rescuers arrive.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Additionally, any directional arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

What is claimed is:

1. A method for surviving an avalanche comprising:

inflating a first expandable member to generally encapsulate a head of a person; said first expandable member comprises an outer layer, and an inner layer disposed distantly from a face of a person whose head is generally encapsulated by the inflated first expandable member, such as to provide a space between the face of the person and the inner layer; and releasing an oxygen-containing substance through an opening in the inner layer and into the space between the face of the person and the inner layer.

2. The method of claim 1 additionally comprising inflating a second expandable member and a third expandable member to protect the chest of the user.

3. The method of claim 2 wherein said inflating the first and third expandable member comprises passing an oxygen-containing substance into said first expandable member and subsequently passing the oxygen-containing substance into said third expandable member.

4. The method of claim 2 wherein said inflating the first and second expandable member comprises passing simultaneously an oxygen-containing substance into said first expandable member and into said second expandable member.

5. The method of claim 2 wherein said inflating said first, said second, and said third expandable members comprises passing an oxygen-containing substance from a canister.

6. The method of claim 2 wherein a portion of said inflated first expandable member depends downwardly to cover portions of said second and third inflated expandable members.

7. The method of claim 1 wherein said first expandable member comprises an inner layer coupled to an outer layer by at least one web member.

8. The method of claim 1 wherein said first expandable member is inflated with an oxygen-containing substance.

9. The method of claim 8 additionally comprising releasing a quantity of the oxygen-containing substance from the first expandable member to assist in surviving an avalanche.

10. The method of claim 9 wherein said inner layer comprises an inner layer transparent section, and said outer layer comprises an outer layer transparent section.

11. The method of claim 8 wherein oxygen-containing substance pressure within said first expandable member ranges from about 0.5 psi to about 10 psi.

12. The method of claim 8 wherein oxygen-containing substance pressure within said first expandable member ranges from about 3.0 psi to about 9 psi.

13. The method of claim 8 wherein oxygen-containing substance pressure within said first expandable member ranges from about 5.0 psi to about 7.0 psi.

* * * * *